United States Patent [19]

Wooge et al.

[11] Patent Number: 4,953,739

[45] Date of Patent: Sep. 4, 1990

[54] CONTAINER OF SOLID COMPOSITION FOR USE AS A HOT-MELT

[75] Inventors: Christian Wooge, Bad Homburg; Joachim Speisebecher, Oberursel, both of Fed. Rep. of Germany

[73] Assignee: Emhart Industries, Inc., Hartford, Conn.

[21] Appl. No.: 368,447

[22] Filed: Jun. 19, 1989

[30] Foreign Application Priority Data

Aug. 12, 1988 [GB] United Kingdom ..... 8819233

[51] Int. Cl.[5] ..... B65D 25/10

[52] U.S. Cl. ..... 220/93; 220/403

[58] Field of Search ..... 206/817; 220/93, 403, 220/404

[56] References Cited

U.S. PATENT DOCUMENTS

| | | | |
|---|---|---|---|
| 237,121 | 2/1881 | Minor | 206/817 |
| 1,830,246 | 11/1931 | Sanford | 206/817 |
| 3,675,912 | 7/1970 | Des Jardins | 206/817 |
| 4,295,565 | 10/1981 | Takeuchi | 206/817 |

FOREIGN PATENT DOCUMENTS 58989 1/1982 European Pat. Off. .

*Primary Examiner*—Joseph Man-Fu Moy

*Attorney, Agent, or Firm*—Spencer T. Smith

[57] ABSTRACT

An improved, moisture-proof container of solid, moisture-curable composition for use as a hot-melt in the apparatus described in U.S. Pat. No. 4,586,636 in which the composition in the container is further retained within a sealed bag of heat-resistant, resilient foil. The foil may be a simple film of polyamide or polyester but for higher-temperature melting a shrinkage-resistant laminate of polyamide or polyester film supported on an aluminium foil may be used.

5 Claims, 2 Drawing Sheets

CONTAINER OF SOLID COMPOSITION FOR USE AS A HOT-MELT

BACKGROUND OF THE INVENTION

The present invention relates to a moisture-proof container of solid, moisture-curable composition for use as a hot-melt as described in our U.S. Pat. No. 4,586,636.

Since moisture-curable compositions are cured by reaction with moisture, it is necessary to inhibit exposure of these compositions to moisture prior to use, and yet to provide for emptying of the container, even only partially, without premature cure of the composition.

Our U.S. patent specification No. 4,586,636, describes the use of apparatus for dispensing a moisture-curable composition provided in a self-supporting package comprising a container having a tubular body portion closed at one end by a closure member provided with an outlet, said container further comprising within the body portion a slideable piston-head so that the composition is confined in the body portion between the piston-head and the closure member, the apparatus comprising exit port means adapted to cooperate with the outlet of the package so as to provide a moisture-proof seal between the outlet and the exit port means, actuating means for pressing the piston-head towards the closure member and the outlet, and means for conducting molten composition from the exit port means to a dispenser nozzle without exposing the composition to atmospheric moisture, characterised in that the composition contained in the package is a solid, moisture-curable adhesive to be dispensed as a melt, that the closure member is heat-receptive and cooperates with means for supplying heat to said closure member and in that the slideable piston-head has a rim projecting towards the closure member and in sliding, sealing engagement with an inner wall of said body portion. In operation heat applied to the closure member melts the composition adjacent said closure member and the molten material so formed is expelled through the outlet by movement of the piston head towards the closure member resulting from pressure applied to said piston-head by the actuating means.

Containers made for use in accordance with the above invention are filled when inverted, having the piston-head located at the lower end which is sealed by a lid which is removed before use. The inner walls of the container are provided with a coating of release material such as PTFE. The container is then filled with molten material, sealed at the upper end by the closure member and the container is then inverted and allowed to cool. With compositions which are crystalline at room temperature, shrinkage on solidification provides a small gap between the walls of the container and the mass of solid composition. When the container is used, the small gap facilitates the passage of the projecting rim of the piston-head when in sliding engagement with the inner wall of the container.

However, difficulties are experienced with noncrystalline compositions which do not shrink to provide the small gap which facilitates the passage of the projecting rim in use and operation of the dispensing apparatus is hindered.

It is one object of the present invention to provide an improved container for use in dispensing a hot-melt using apparatus described in U.S. Pat. No. 4,586,636 which is easily usable with a non-crystalline composition.

Difficulties are also experienced with larger containers filled with crystalline composition since the mass of the composition can produce irregular shrinkage which produces voids which permit the entry of molten material when the apparatus is used and this backflow of molten material may even pass the seal provided by the projecting rim of the piston-head engaging the inner wall of the container.

It is accordingly a further object of the present invention to provide an improved container for use in the apparatus described in European patent specification 0102804 which obviates the backflow of molten materials against the projecting rim of the piston-head.

BRIEF DESCRIPTION OF THE INVENTION

According to the present invention, a moisture-proof container of solid, moisture-curable composition for use in the apparatus described in U.S. Pat. No. 4,586,636 comprising a tubular body portion closed at one end by a closure member provided with an outlet, and further comprising a slideable piston-head confining the composition in the body portion between the piston-head and the closure member, said piston-head having a rim projecting towards the closure member and in sliding, sealing engagement with the inner walls of said tubular body portion, is characterised in that the moisture-curable composition within the container is further retained within a sealed bag of heat-resistant, resilient foil.

For compositions melting at temperatures of less than 125° C., the foil may be a simple film of polyamide or polyester material such as biaxially-oriented polyethylene terephthalate but such films exhibit unacceptable shrinkage at higher temperatures and for compositions melting at higher temperatures a shrinkage-resistant laminate film may be used in which an inner layer of e.g. polyethylene terephthalate is supported on aluminium foil. A preferred laminate foil especially for use with compositions melting at higher temperatures is further provided with an outer layer of heat-resistant film such as heat-resistant polyethylene.

An improved container in accordance with the present invention is filled in a similar manner to the containers hitherto used with the apparatus described in U.S. Pat. No. 4,586,636, a bag of heat-resistant resilient foil being inserted into the inverted container, filled with molten composition and the mouth of the bag sealed to the container with the closure member before the sealed container is inverted and cooled as previously described.

Although the container is especially for use with moisture-curable hot-melt materials, it can also be used to contain any solid composition for use as a hot-melt which is to be held in moisture-free conditions.

BRIEF DESCRIPTION OF THE DRAWINGS

In order that the present invention be better understood a preferred embodiment will now be described by way of example and in greater detail with reference to the accompanying drawings which diagrammatically illustrate the filling and use of a container according to the invention and in which.

DETAILED DESCRIPTION OF THE DRAWINGS AND PREFERRED EMBODIMENTS

Figure 1:
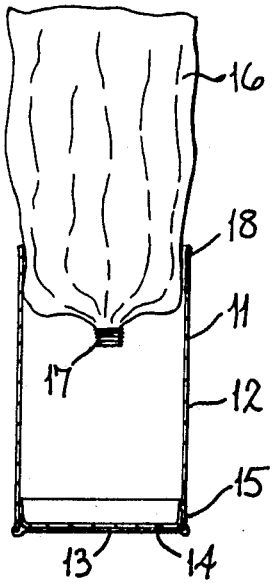
FIGS. 1 and 2 diagrammatically illustrate the insertion of a bag of heat-resistant, resilient film.
Figure 2:
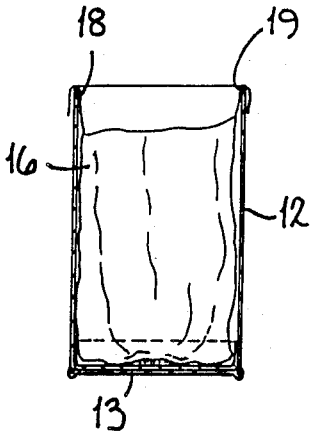
Figure 3:
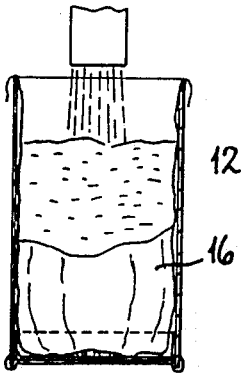
FIG. 3 illustrates filling the container with molten composition.
Figure 4:
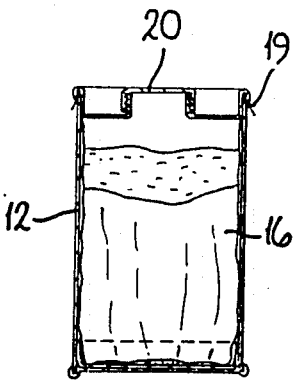
FIG. 4 illustrates the sealing of the container.
Figure 5:
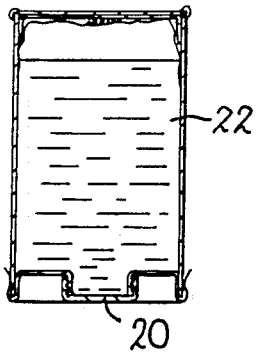
FIG. 5 illustrates the cooling stage of the filled container.

The filling sequence of a container according to the present invention is illustrated in FIGS. 1 to 5. A container 11 comprising a tubular body portion 12 having a sealing lid 13 at one end contains a piston-head 14. Container 11 stands with piston-head 14 at the lower end 15 of body portion 12 (FIG. 1). A bag 16 of biaxially-oriented polyethylene terephthalate is formed by sealing one end of a tube of the polyester film with clip 17 and inserted in the opening at upper end 18 of body portion 12. The bag 16 is spread to form a lining to the container (FIG. 2) and the open end 19 of the bag turned over the upper end 18 of body portion 12. As illustrated in Figure 3, the container lined with bag 16 is filled with molten composition at 100° C. A closure member 20 is then applied to upper end 18 of body portion 12 (FIG. 4) and, in sealing closure member 20 to body portion 12, the open end 19 of bag 16 is also sealed to body portion 12.

The filled container is then inverted (FIG. 5) and allowed to cool.

Figure 6:
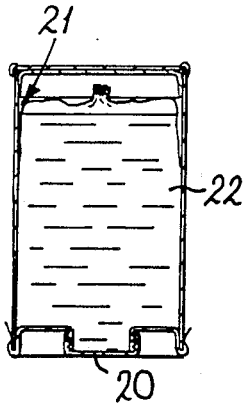
FIG. 6 illustrates the storage condition of the container.

The container in storage condition is illustrated in FIG. 6, with an ambient (room) temperatures of 20° C.

With a composition which is crystalline at room temperature, a small gap 21 occurs between solid composition 22 and body portion 12 but with a composition which is non-crystalline at room temperature, no such small gap occurs.

Figure 7:
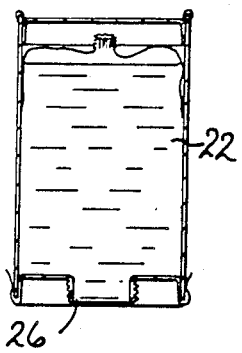
FIG. 7 illustrates opening the container for use.
Figure 8:
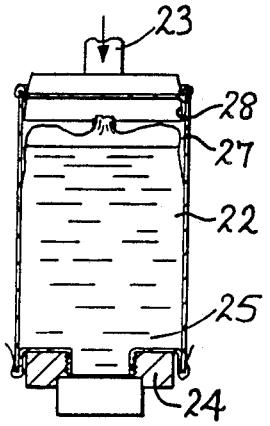
FIGS. 8 and 9 illustrate stages in the use of the container.

In use, the container is opened by removal of sealing lid 13 (FIG. 7) and the container inserted in the dispensing apparatus and actuating means 23 moves piston-head 14 in body portion 12 towards the solid composition 22 and heat from electrically-heated platen 24 passes through closure member 20 to melt the adjacent portion 25 of composition 22. (FIG. 8).

Figure 9:
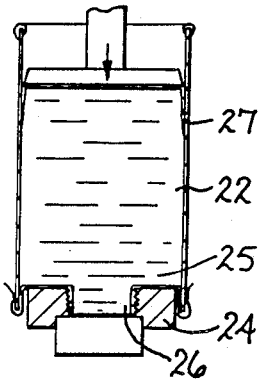

The operation of the apparatus is illustrated in FIG. 9 and pressure applied by actuating means 23 moves piston-head 14 into contact with composition 22 and the polyester foil at 27 effectively provides a small gap to facilitate the movement of projecting rim 28 in contact with the wall of body portion 12 and outside the composition 22. The pressure applied to piston-head 14 by actuating means 23 is transmitted to composition 22 and the molten composition at 25 thereby expelled from outlet 26 in closure member 20.

Figure 10:
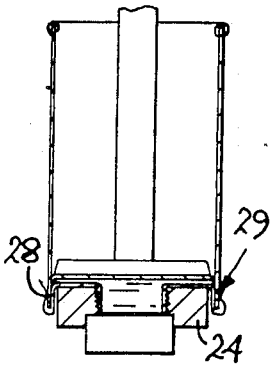
FIG. 10 illustrates the emptied container.

FIG. 10 shows the final operating position of the apparatus in which projecting rim 27 engages in recess 29 in closure member 20 and this enables piston-head 14 to make such close contact with closure member 20 that practically all the composition 22 is expelled as molten material through outlet 26 of closure member 20.

The empty container is then removed from the apparatus and replace by a container containing solid composition.

We claim:

1. A moisture-proof container of solid, moisture-curable composition comprising a reusable tubular body portion open at one end, a closure member provided with an outlet removably secured to said open end to close said tubular body portion, a slideable piston-head confining the composition in the body portion between the piston-head and the closure member, said piston-head having a rim projecting towards the closure member and in sliding, sealing engagement with the inner walls of said tubular body portion a bag of heat-resistant resilient foil open at one end and secured around said open end by said closure member, said bag being unattached to said tubular body portion, and solid, moisture-curable composition contained within the receptacle defined by said bag and said closure member.

2. A container according to claim 1, wherein the foil is a simple film of polyamide or polyester material.

3. A container according to claim 2, wherein the film is biaxially-oriented polyethylene terephthalate.

4. A container according to claim 1, wherein the foil is a shrinkage-resistant laminate comprising an inner layer of polyamide or polyester supported on aluminium foil.

5. A container according to claim 4, wherein the laminate further comprises an outer layer of a heat-resistant film.

* * * * *